US009144532B1

(12) United States Patent
Renner et al.

(10) Patent No.: US 9,144,532 B1
(45) Date of Patent: Sep. 29, 2015

(54) INFLATABLE BABY PACIFIER WITH METHOD

(71) Applicants: Ronald G. Renner, Reno, NV (US); Craig T Etling, Reno, NV (US); Michael J Botich, Reno, NV (US)

(72) Inventors: Ronald G. Renner, Reno, NV (US); Craig T Etling, Reno, NV (US); Michael J Botich, Reno, NV (US)

( * ) Notice: Subject to any disclaimer, the term of this patent is extended or adjusted under 35 U.S.C. 154(b) by 0 days.

(21) Appl. No.: 14/314,914

(22) Filed: Jun. 25, 2014

Related U.S. Application Data

(60) Provisional application No. 61/982,476, filed on Apr. 22, 2014.

(51) Int. Cl.
*A61J 17/00* (2006.01)

(52) U.S. Cl.
CPC ..... *A61J 17/00* (2013.01); *A61J 2017/001* (2013.01)

(58) Field of Classification Search
CPC ..... A61J 17/00; A61J 2017/001; A61J 2017/006; A61J 2017/008; A61J 11/001; A61J 11/002; A01K 9/00; A01K 9/005; A01K 39/0213; A01K 15/025; A01K 15/026; A63B 71/085
USPC ..... 606/234–236
See application file for complete search history.

(56) References Cited

U.S. PATENT DOCUMENTS

| | | | | |
|---|---|---|---|---|
| 5,743,443 | A * | 4/1998 | Hins | 222/490 |
| 2004/0237965 | A1* | 12/2004 | Bibi et al. | 128/206.29 |
| 2007/0027478 | A1* | 2/2007 | Tesini et al. | 606/234 |

* cited by examiner

*Primary Examiner* — David C Eastwood
*Assistant Examiner* — Martin T Ton
(74) *Attorney, Agent, or Firm* — John D. Long, Esq.; Long & Chybik

(57) ABSTRACT

An inflatable baby pacifier and a method of operating same, the inflatable baby pacifier comprising a two-sided skin contacting plate that supports a gas pump, a valve, and an adjustable pneumatic nipple; the gas pump being supported on one side of the two-sided skin plate; the adjustable pneumatic nipple forming a hollow interior, the adjustable pneumatic nipple being supported on an other side of the two-sided skin plate; the valve connects the gas pump to the hollow interior; wherein the gas pump is capable of sending a gas through the valve into the hollow interior.

18 Claims, 15 Drawing Sheets

INFLATABLE BABY PACIFIER WITH METHOD

STATEMENT REGARDING FEDERALLY SPONSORED RESEARCH OR DEVELOPMENT

Not Applicable

REFERENCE TO A "MICROFICHE APPENDIX"

Not Applicable.

FIELD OF THE INVENTION

The present invention may relate to baby pacifiers with hollow nipples. More specifically, the present invention may related to baby pacifiers that can provide and adjust for the inflation of the respective hollow nipples.

BACKGROUND

Infant or baby oral pacifiers can be seen as a form of an artificial nipple upon which an infant may suckle. The suckling action upon the nipple (generally fluids generally do not pass through the pacifiers) is thought to provide a soothing or calming means to the baby. Further during the teething process, a burning and itching sensation can be felt the infant's gums. The infant's chewing action upon the nipple may provide a temporary alleviation of such sensations.

The pacifier could be seen as having three (3) recognizable parts: the nipple that is placed in the infant's mouth; a skin contacting plate or shield that generally limits the depth of insertion of the nipple within the infant's mouth; and a ring or other protrusion substantially allowing the pacifier to be gripped (e.g., by the infant.) The nipple in many such instances is an elongated member descending from the middle of the plate. The nipple could be hollow and made from a suitable pliable or resilient polymer. The nipple could have a hollow interior that could be sealed off to give the nipple an overall balloon-like construction, which allows the nipple to be suitably deformed by the baby's suckling action but will go back to its original shape when removed from the baby's mouth.

One possible issue for such pacifiers is that their nipples can be seen as not taking into account the change or growth that a baby undergoes during the early stages of its life. As a newborn, the baby, lacking teeth, may utilize the pacifier as soothing instrument so that the nipple can fulfill this function by being merely soft and supple. As the baby leaves the newborn stage and begins its teething stages, where the baby's teeth begin to emerge from the gum line. The nipple, in order to continue its soothing mission, needs to be more resilient to provide a to harder surface for the baby to chew upon during the teething process. Generally, the present pacifier with its non-changing nipple capacity may not being able to meet the change of the baby's suckling needs as the baby goes from newborn to teething infant.

What could be needed is a pacifier having an adjustable nipple that can be altered to meet the changes in the suckling/teething needs of the baby as it ages. One such possible solution to this issue could be the present invention of an inflatable baby pacifier with an adjustable pneumatic nipple. A gas pump connected to the adjustable pneumatic nipple can be used to insert an amount of gas (e.g., air) past a valve and into a hollow interior of an adjustable pneumatic nipple. This and other valves connected to the adjustable pneumatic nipple can further suitably alter the amount of gas within the adjustable pneumatic nipple to change the nipple's operational characteristics (e.g., suppleness/flaccidity for soothing suckling action to more resilience or hardness for chewing/teething action.)

In at least one invention embodiment, gas is pumped from the environment outside the invention into the adjustable pneumatic nipple and as needed or when needed gas could be then released from the hollow back out to the outside environment. In another embodiments, the gas may be fully self-contained within the pacifier itself and is moved through valve(s) between a containment area (e.g., gas pump) and the nipple's hollow interior.

Various embodiments of the invention could only have one valve is used to control passage of gas both into and out of the hollow interior. Other various embodiments of the invention, a first valve or set of first valves could control the movement of gas into the hollow interior wherein a second valve or set of second valves could control of the movement of gas out of the hollow interior. In still yet further embodiments of the invention an additional set of third valve(s) are used as relief valve(s) to prevent pressure in the hollow interior from exceeding a preset level.

SUMMARY OF ONE EMBODIMENT OF THE INVENTION

Advantages of One or More Embodiments of the Present Invention

The various embodiments of the present invention may, but do not necessarily, achieve one or more of the following advantages:

the ability to adjust the firmness or suppleness of the pacifier nipple;

to provide a pacifier with a gas pump that connects to a hollow interior of an adjustable pneumatic nipple to inflate an adjustable pneumatic nipple to desired firmness;

the ability to move a gas from an environment outside of the pacifier into a hollow interior formed by the pacifier's nipple;

provide a pacifier that can vent a gas from a pacifier's adjustable pneumatic nipple out to the environment that is external to the pacifier;

the ability to adjust an inflation of the pacifier's adjustable pneumatic nipple with one or more valves;

provide an adjustable pneumatic pacifier nipple that can vent gas from nipple's interior through a valve back into another part of the pacifier;

the ability to automatically relief an amount of a gas from an adjustable pneumatic nipple of a pacifier when the gas pressure within the nipple reaches a preset set level;

to provide a pacifier that can be adjusted to from an infant's sucking need to its teething needs as the infant grows older; and the ability to allow an operator to adjust the hardness or suppleness of an inflatable pacifier nipple through the regulation of one or more valves.

These and other advantages may be realized by reference to the remaining portions of the specification, claims, and abstract.

Brief Description of One Embodiment of the Present Invention

One possible embodiment of the invention could be a pacifier with a pneumatically inflated nipple comprising of a two-sided skin contacting plate supporting on one side a gas pump and supporting on the other side a pneumatic nipple having a hollow interior, the gas pump and hollow interior being connected by at least one valve, where the at least one valve is constructed so that a gas moving from the hollow interior meets greater resistance from the at least one valve than does the gas moving from the gas pump to the hollow interior.

Another possible embodiment of the invention could be a pacifier with an pneumatically inflated nipple comprising of two-sided skin contacting plate supporting on one side a gas pump and supporting on the other side a pneumatic nipple having a hollow interior, the gas pump and hollow interior being connected by a first valve, which allows a gas to easily pass from the gas pump to the hollow interior but resists the movement of the gas from the hollow interior back into the gas pump and a second valve which connects to the hollow interior controls the exhausting of gas from the hollow interior.

Still yet another possible embodiment of the invention could be a method or process for an operation of a pacifier with a gas pump inflated nipple, comprising of the following steps: providing a pacifier with a two-sided skin contacting plate, one side supporting a gas pump and the other side supporting a pneumatic nipple forming a hollow interior, the hollow interior being continuously connected by a valve to the gas pump, wherein valve allows passage of a gas from the gas pump to the hollow interior but presents a resistance to the exhausting of gas from the hollow interior; activating the gas pump to send gas to the valve; passing gas through the valve into the hollow interior of the pneumatic nipple; increasing the gas pressure within the hollow interior to increase the hardness of the pneumatic nipple.

The above description sets forth, rather broadly, a summary of one embodiment of the present invention so that the detailed description that follows may be better understood and contributions of the present invention to the art may be better appreciated. Some of the embodiments of the present invention may not include all of the features or characteristics listed in the above summary. There are, of course, additional features of the invention that will be described below and will form the subject matter of claims. In this respect, before explaining at least one preferred embodiment of the invention in detail, it is to be understood that the invention is not limited in its application to the details of the construction and to the arrangement of the components set forth in the following description or as illustrated in the drawings. The invention is capable of other embodiments and of being practiced and carried out in various ways. Also, it is to be understood that the phraseology and terminology employed herein are for the purpose of description and should not be regarded as limiting.

DESCRIPTION OF CERTAIN EMBODIMENTS OF THE PRESENT INVENTION

In the following detailed description of the preferred embodiments, reference is made to the accompanying drawings, which form a part of this application. The drawings show, by way of illustration, specific embodiments in which the invention may be practiced. It is to be understood that other embodiments may be utilized and structural changes may be made without departing from the scope of the present invention.

Figure 1:
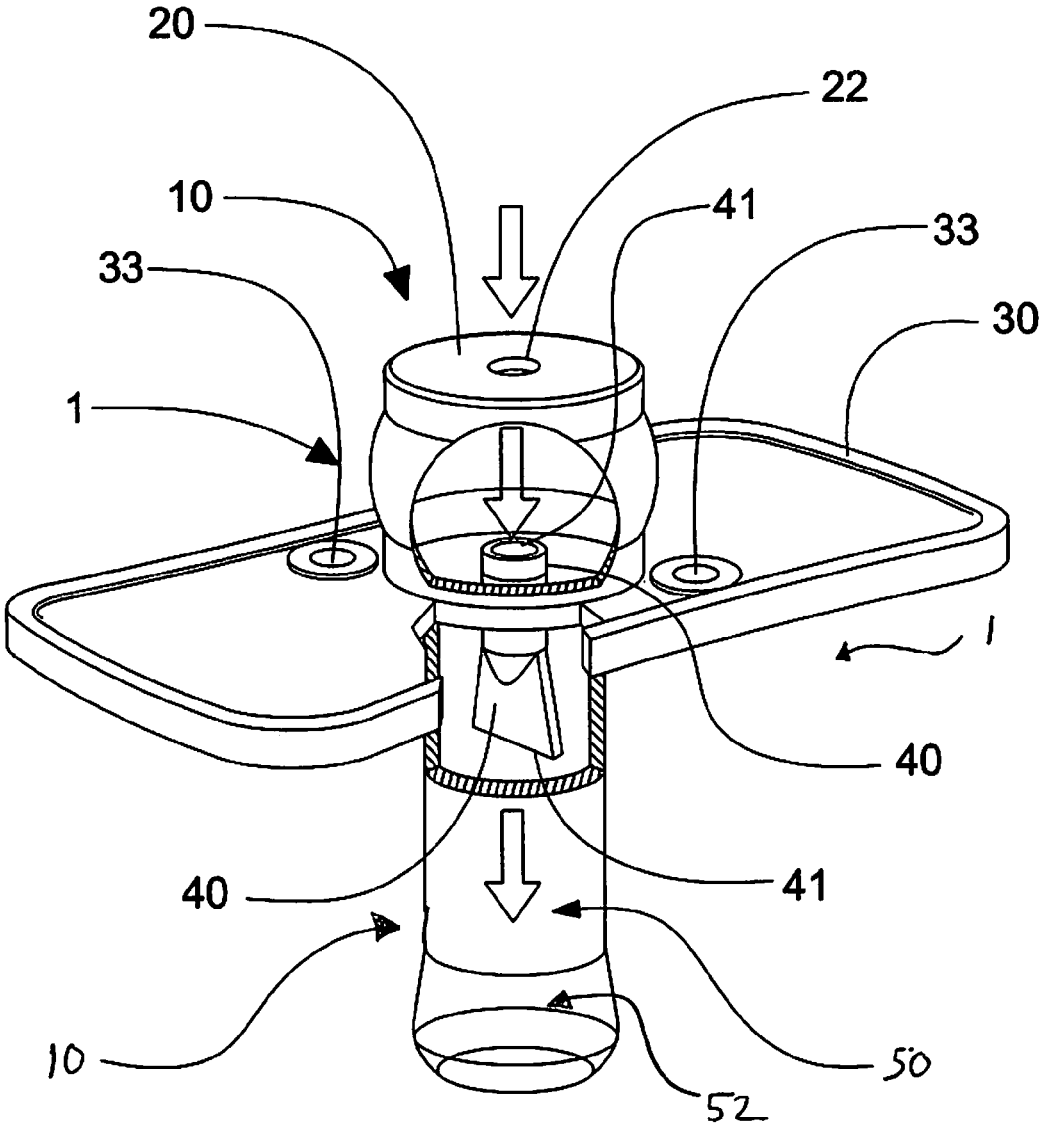
FIG. 1 is substantially showing a cutaway perspective view of a one valve embodiment of the present invention.
Figure 1A:
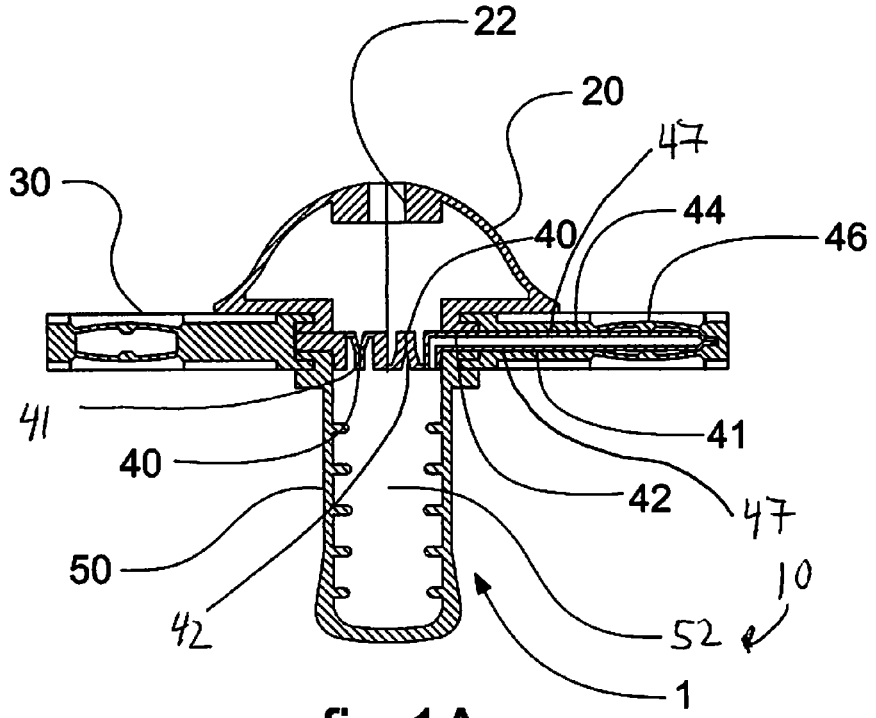
FIG. 1A is substantially showing a cutaway side elevation view of a slit valve embodiment of the present invention.
Figure 1B:
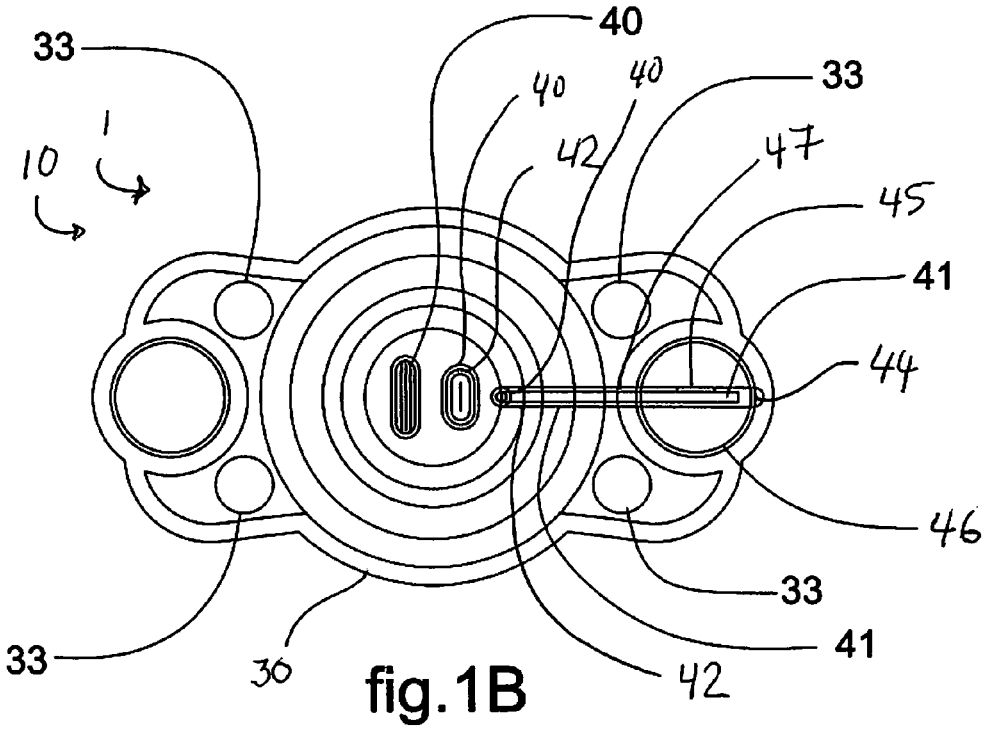
FIG. 1B is substantially showing a top view of a slit valve embodiment of the present invention.
Figure 2:
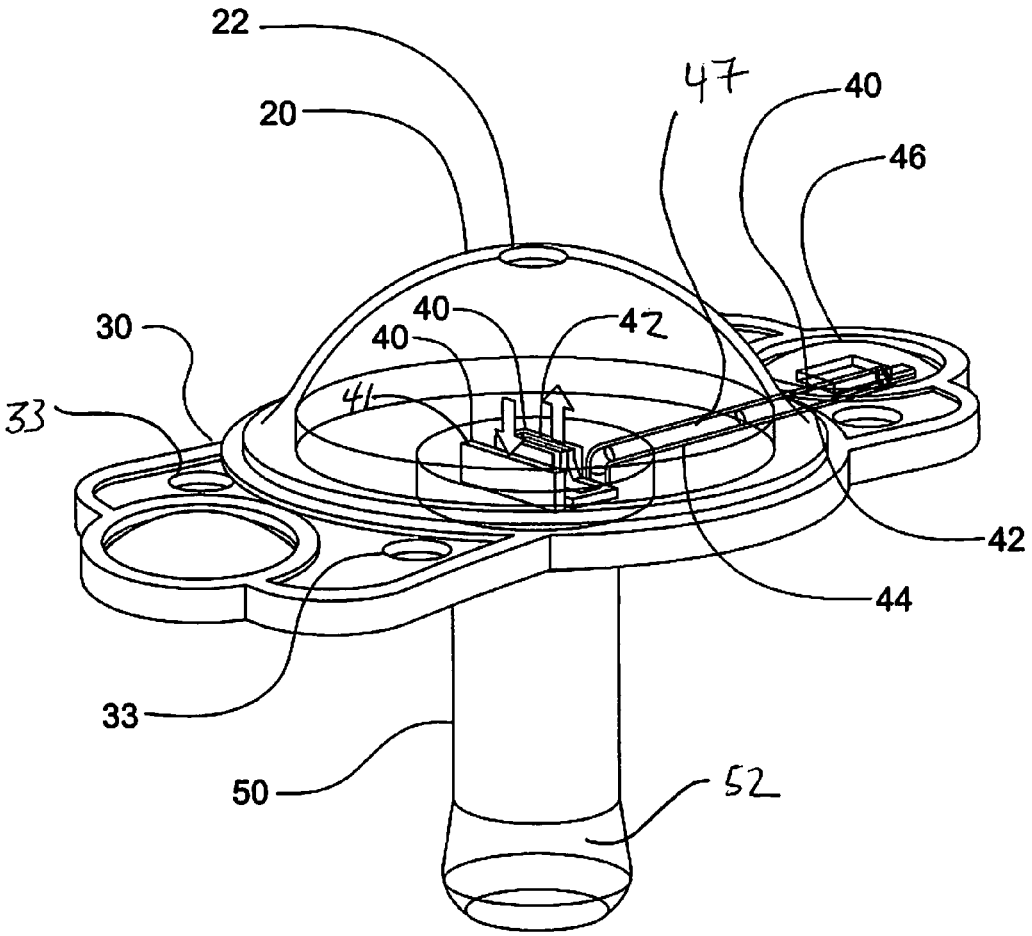
FIG. 2 is substantially showing a perspective cutaway view the slit valve embodiment of the present invention.

The present invention 1 could comprise an inflatable baby pacifier 10 and a method of operating same 200. As substantially shown in FIG. 1, one possible embodiment of the inflatable baby pacifier 10 could comprise a gas pump 22 (e.g., a compressible chamber) connected by a skin contacting shield or plate 30 to an adjustable pneumatic nipple 50. The skin contacting plate 30 in one version could further feature anti-suffocation orifices 33 and could support on one side the gas pump 20 and while the other side supports the adjustable pneumatic nipple 50 forming a hollow interior 52. At least one valve 40 (e.g., an intake valve 41) can controllably connect the gas pump 20 to the hollow interior 50 of the adjustable pneumatic nipple 50. In one version, the valve 40 is generally an intake-only valve 41 that substantially allows gas (e.g., air) contained within the gas pump 20 only to move into the hollow interior 50 and generally not out of the hollow interior 50. Gas in the gas pump 20 is directed to the valve 40 when an operator's thump (not shown) is placed over hole 22 at the top of the gas pump 20 (e.g., a compressible chamber.) This sealing action allows the operator (not shown) to compress the gas pump 20 with its hand/thumb to generally force at least a portion of the gas within the gas pump 20 through the valve 40 and into the adjustable pneumatic nipple's hollow interior 52. The valve 40 could be constructed to allow gas to move easily in one direction through the valve 40 into the hollow interior 51. The valve's construction could further provide significantly greater resistance to the passage of gas the other way (e.g., exiting from the hollow interior 51.) In this manner, the operator (e.g., child's parent) could repeatedly pump up the air pressure within the hollow interior (e.g., sealing the gas pump with thumb; pressing down upon/compressing the pump, unsealing the pump [e.g., removing the thumb from the hole 22]; and allowing the pump resume its original shape then repeating these steps) to create the desired firmness of the adjustable pneumatic nipple 50. The valve's resistance to gas being forced out of the hollow interior 52 could be such that the pressure of a child suckling on the pneumatic nipple 50 generally could not be enough force gas out of the adjustable pneumatic nipple 50. The valve construction could further allow for certain pressure exerted upon the adjustable pneumatic nipple 50 (e.g., an adult squeezing the nipple 50 by hand) to generally overcome the valve's resistance to exhaust gas flow. In this manner, by operating the gas pump 20 and/or by squeezing the adjustable pneumatic nipple by hand, the operator (not shown) could obtain the desire gas pressure in the hollow interior 51 to adjust pneumatic nipple's firmness for the baby's suckling or teething needs.

Figure 3:
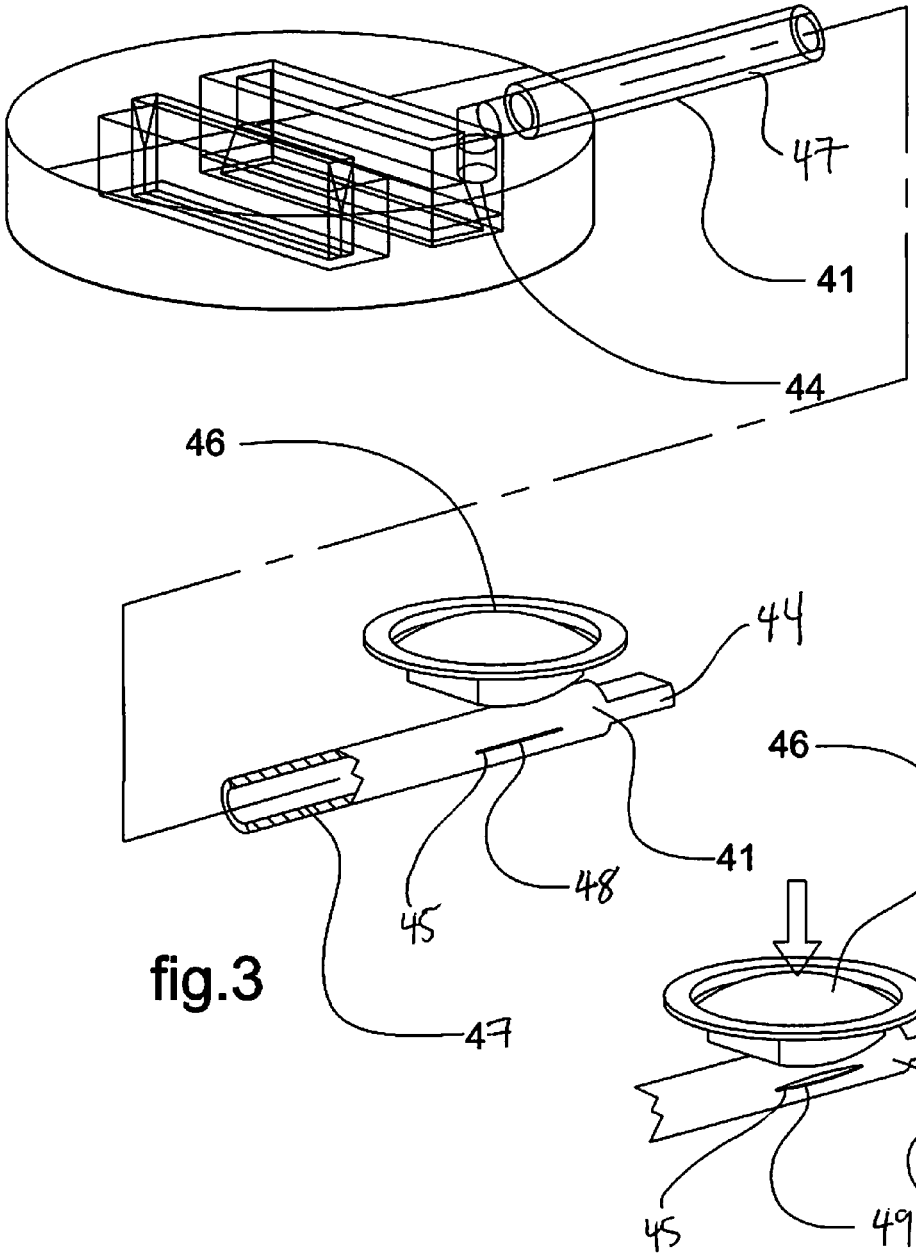
FIG. 3 is substantially showing the exploded cutaway view of a hollow tube and vent slit valve in the closed position.
Figure 3A:
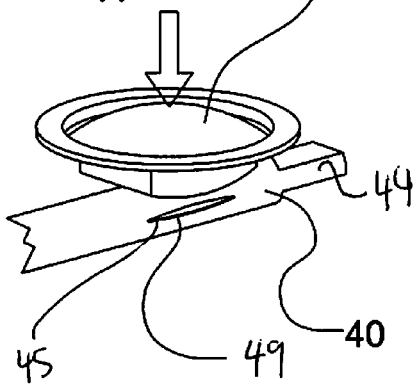
FIG. 3A is substantially showing a perspective view of a hollow tube and vent slit in the closed position of a multiple valve embodiment of the present invention.
Figure 4:
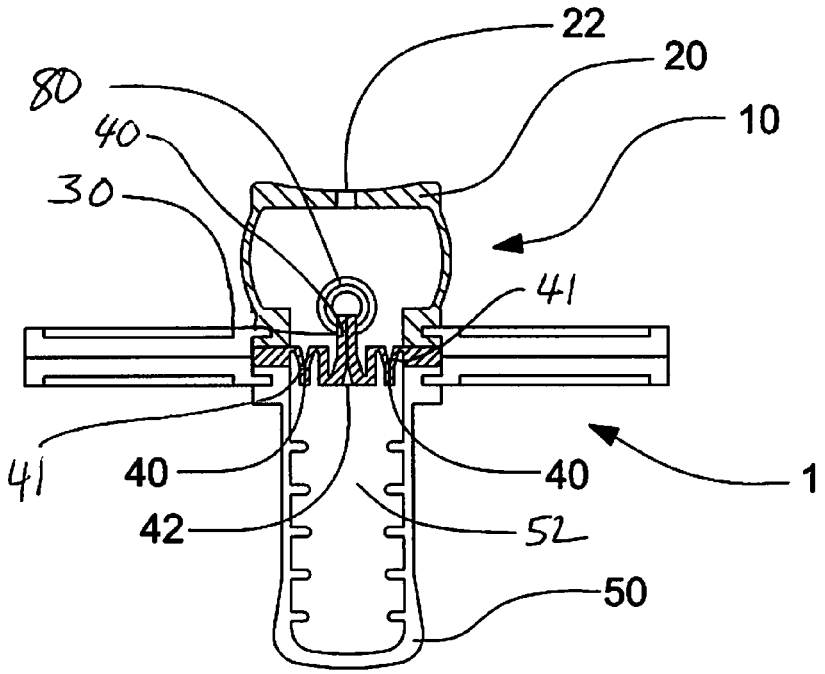
FIG. 4 is substantially showing a side-based, cross-section, elevational view of yet another multiple valve embodiment of the present invention.
Figure 4A:
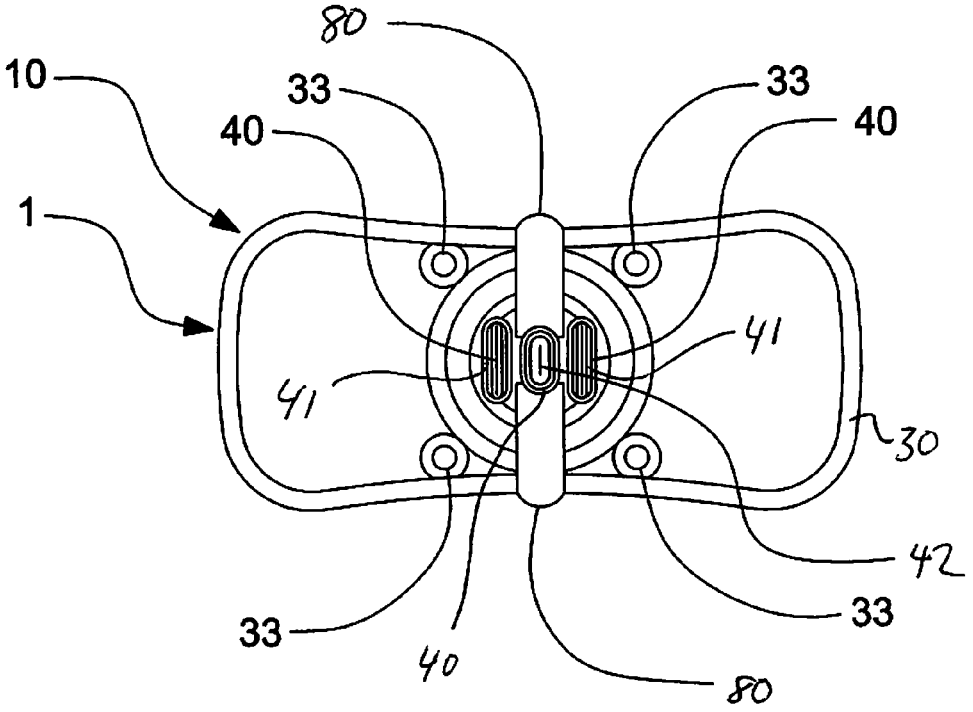
FIG. 4A is substantially showing a top view of yet another multiple valve embodiment of the present invention with the gas pump removed to show the contact of buttons upon the exhaust one way valve.
Figure 5:
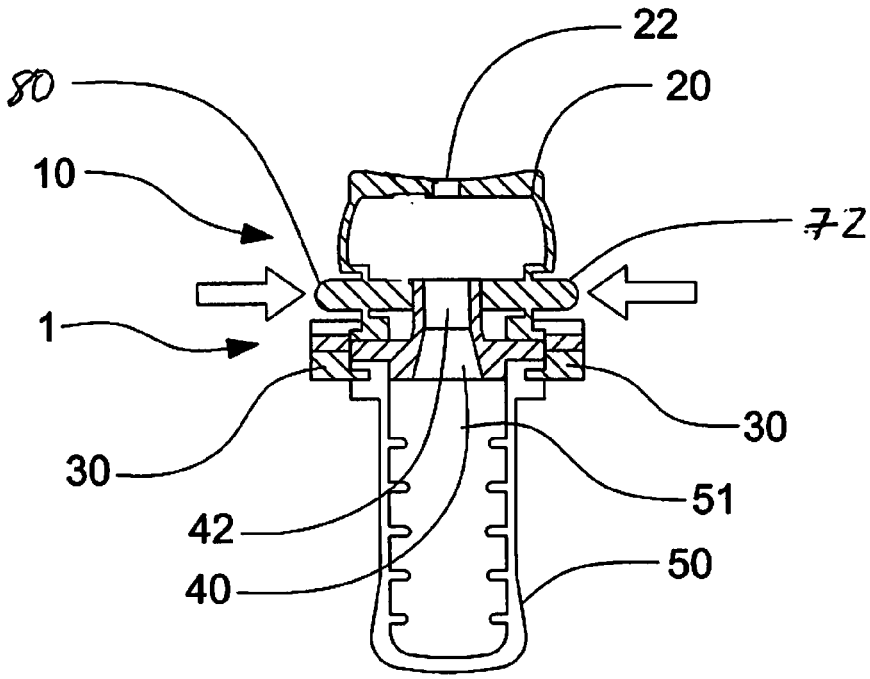
FIG. 5 is substantially showing an end-based, cross-section, elevational view of yet another multiple valve embodiment of the present invention.
Figure 5A:
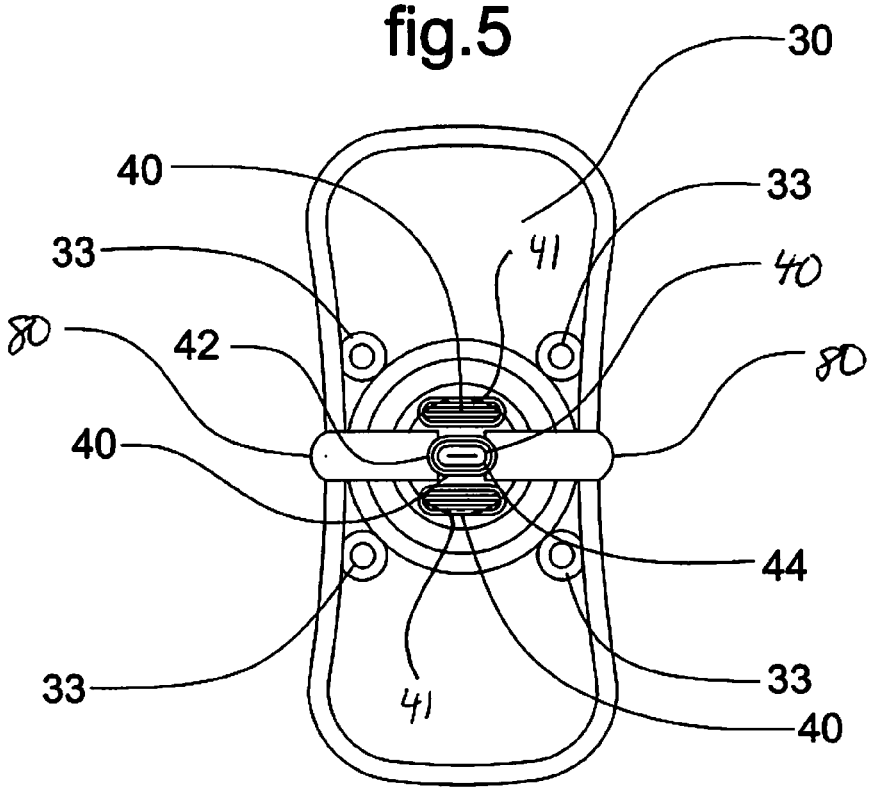
FIG. 5A is substantially showing a top showing a top view of yet another multiple valve embodiment of the present invention with the gas pump removed to show the contact of buttons upon the exhaust one-way valve.
Figure 6:
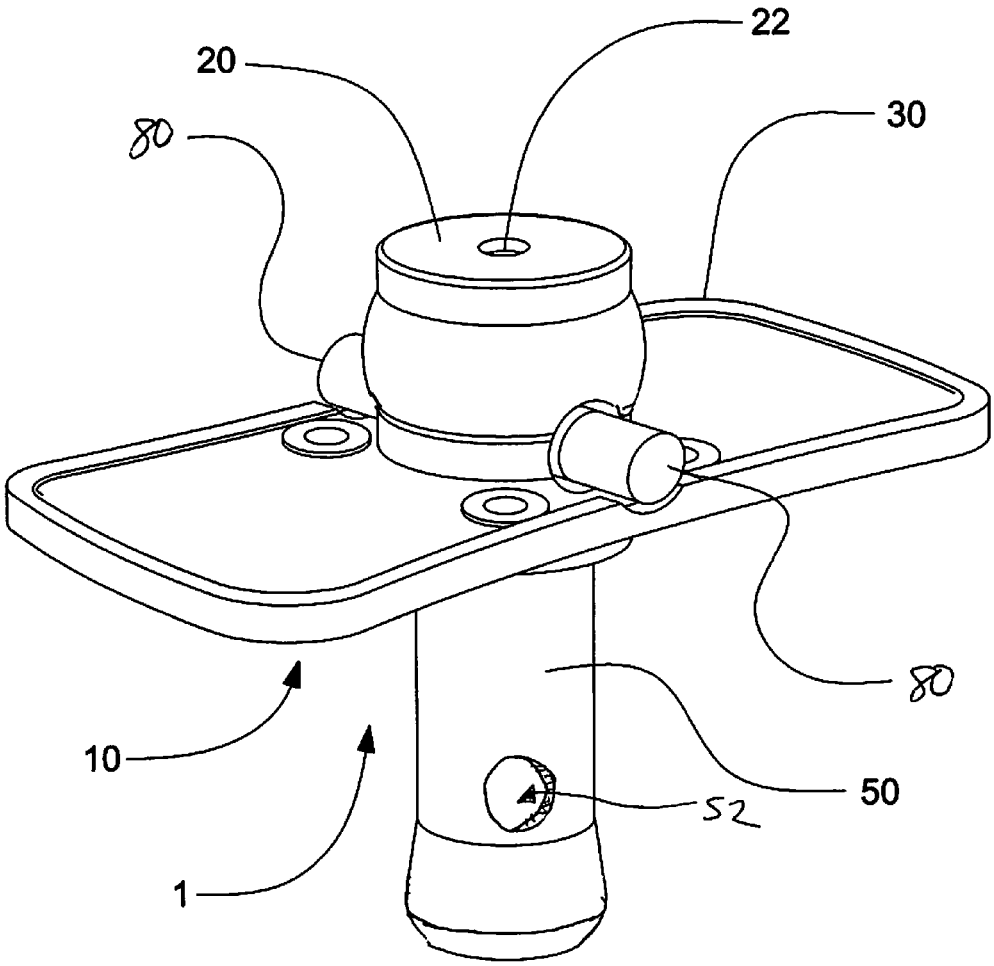
FIG. 6 is substantially showing a perspective cutaway view of yet another multiple valve embodiment of the present invention.

Other versions of the invention 10 could further comprise a second gas valve 42 that could be used to control the movement of gas from the hollow interior 51 (e.g., venting gas to an outside atmosphere.) As substantially shown in FIGS. 1A, 1B, 2, 3, 3A and 11, one example of this exhaust valve 42 could be a slit valve 44 generally supported by the skin contacting plate 30 could comprise a hollow vent tube 46 that at one open end is continuously connected to the hollow interior 52 while the hollow vent tube's other end generally features a horizontal vent slit 45 (as substantially shown in FIGS. 3, 3A, 3B) running along an end length of the hollow tube 41. In its normal operating state, the vent slit 42 is closed and prevents the passage of gas out from the hollow interior 52 (e.g., to outside atmosphere.) A movable button 46 in the skin contacting plate 30 and generally located over the location of the vent slit 44. The depressing of the movable button 46 upon the hollow tube end with the vent slit 45 will deform the vent slit 45 from a closed sealed position 48 into an open venting position 49. In this open position 49, the vent or slit valve 44 will connect the hollow interior 52 with an outside atmosphere to vent at least some of the hollow interior's gas to generally lower the gas pressure of the adjustable pneumatic nipple 50 and decrease its firmness. When pressure is removed from the button 46, the resiliency of the hollow tube move the slit 45 back into the closed position 48.

As substantially shown in FIGS. 4, 4A, 5, 5A and 6, another embodiment of the invention 10 could utilize a set of exhaust buttons 72 to momentarily deform an exhaust valve 42 that are placed to effectively sandwich the exhaust valve 42 between the two exhaust buttons 72. When the buttons 72 are simultaneously pressed (by the operator—not shown) against the exhaust valve 42, the exhaust valve 42 could be deformed to the point that the exhaust valve 42 allows passage of gas out from the hollow interior 51. When the exhaust buttons 72 are released and are no longer pressing against the exhaust valve 42, the exhaust valve 42 could assume its original shape to block passage of gas moving out of the hollow interior 52.

Figure 7A:
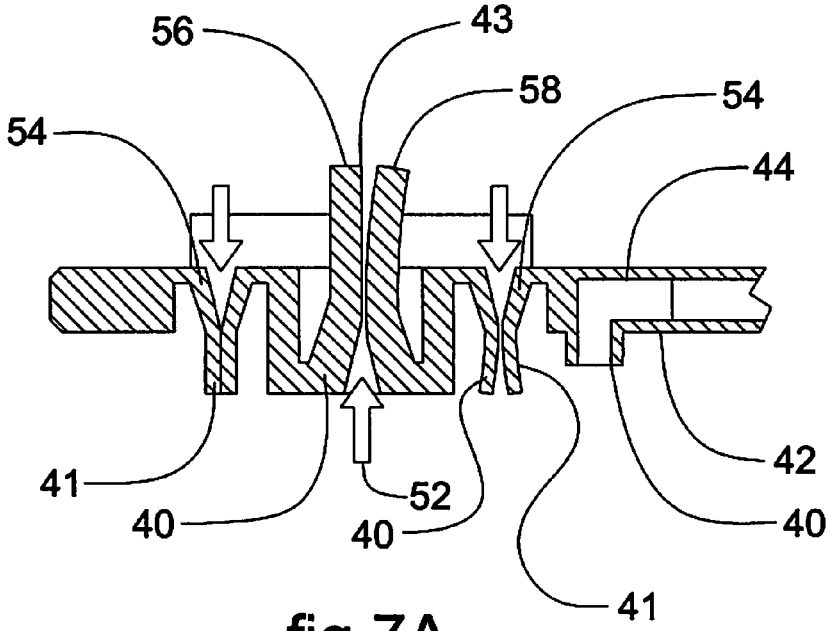
FIG. 7A is substantially showing side elevation cross section view of two intake duck valves sandwiching an exhaust duck valve for multiple valve embodiment.
Figure 7:
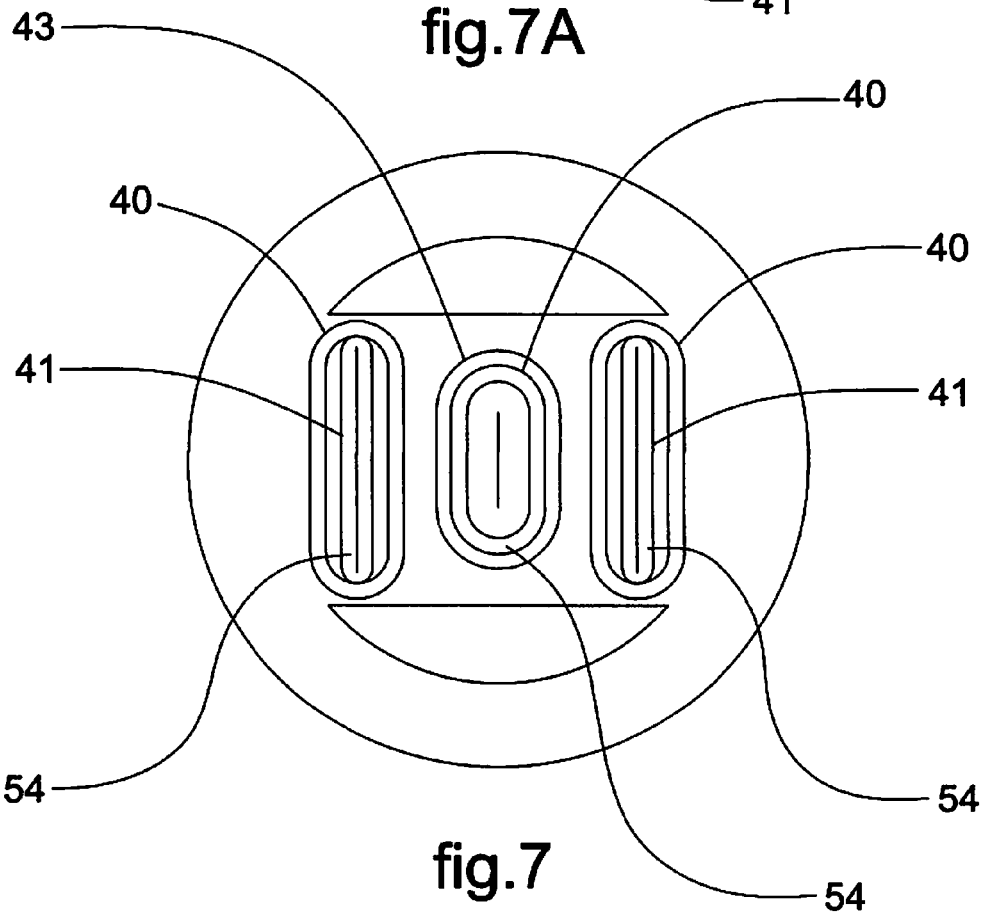
FIG. 7 is substantially showing a top view of two intake valves sandwiching an exhaust valve for multiple valve embodiment.
Figure 8:
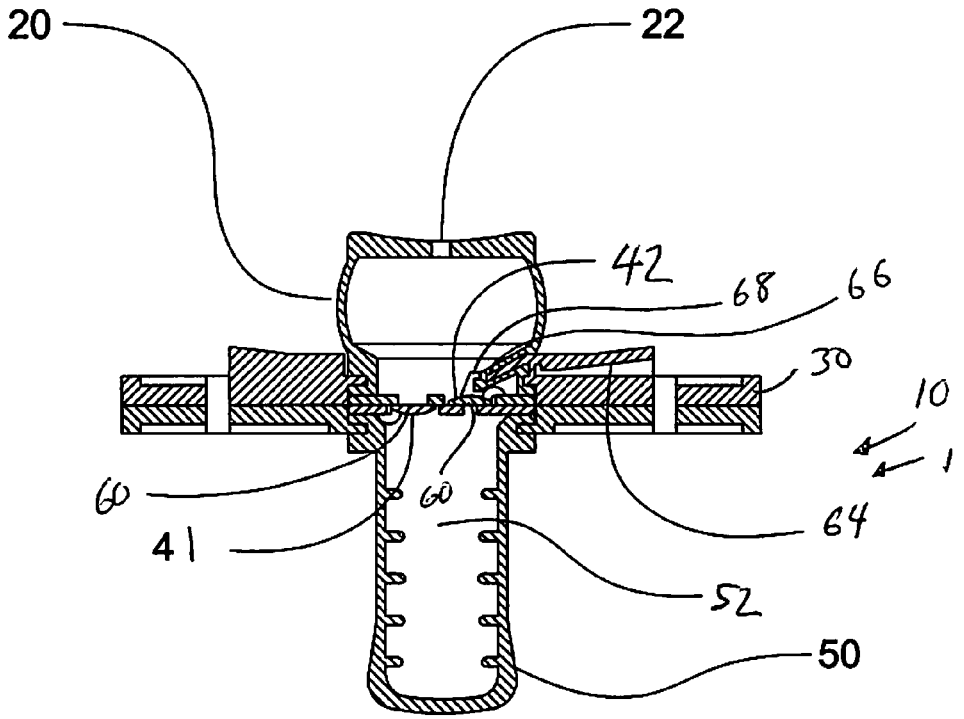
FIG. 8 is substantially showing a side elevation cross section view of yet another multi-valve embodiment of the invention using duck valves.
Figure 8A:
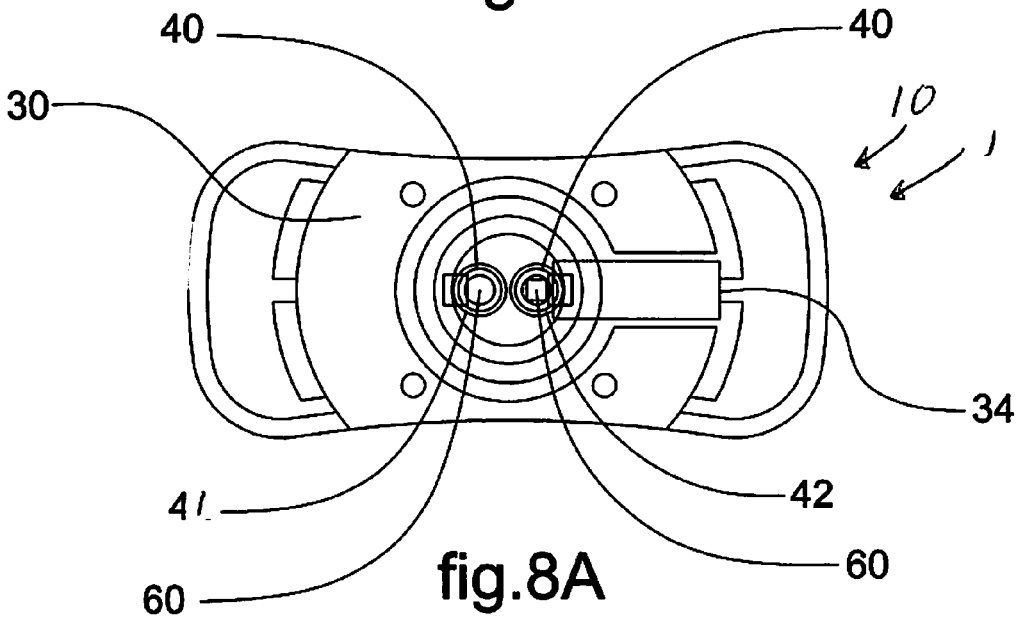
FIG. 8A is substantially showing a top view of yet another multi-valve embodiment of the invention with the gas pump removed to display disk or flap valves.
Figure 9A:
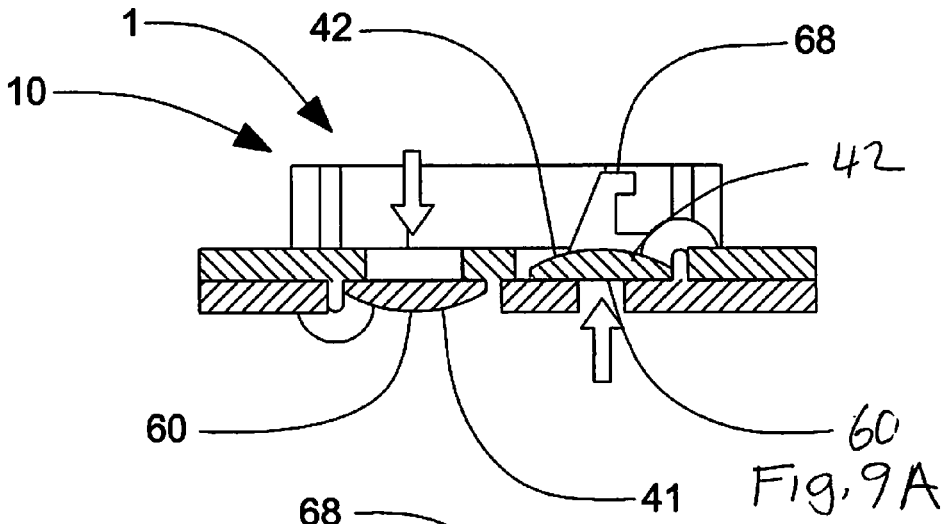
FIG. 9A is substantially showing a side elevation cut away of yet another multi-valve embodiment of the invention showing the flap valves.
Figure 9:
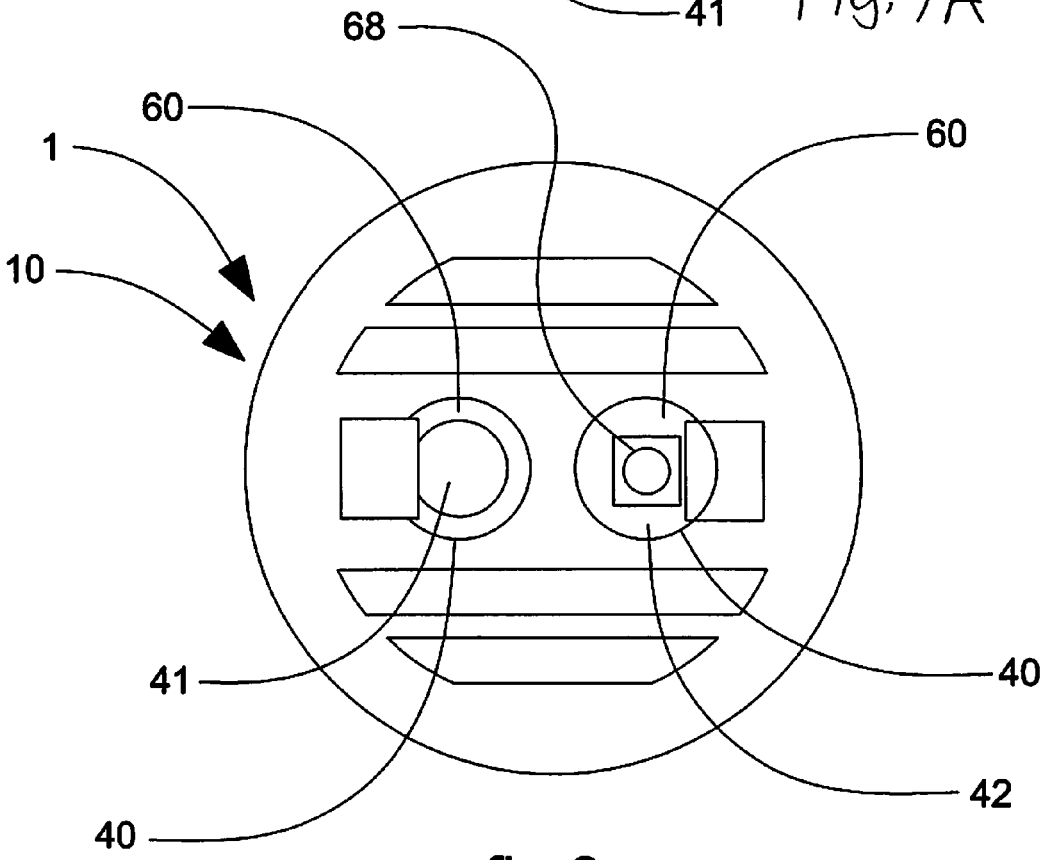
FIG. 9 is substantially showing top view of yet another multi-valve embodiment of the invention showing the top of the disk or flap valves.

As substantially shown in FIGS. 7 and 7A, one valve type that can be used for the valve 40 (for either the intake valve 41, the exhaust valve 42, or the like) could be known as a "duck" or "duck bill" type valve 54. The term "duck" valve 54 could be commonly used industrial term to substantially describe a type of one-way or check valve that is made of an elastomeric material make of split sections roughly assembled in the manner of duck's bill. Gas pressing against the front or tip of the duck bill valve meets resistance by the valve to the gas's passage through the valve as gas pressure upon the two split section presses the sections together in a closed manner. Gas pressing against the opposite or back end (e.g., more open portion) of the valve has the opposite effect in pushing the two split sections apart for gas passage through the valve. In this manner, the exhaust valve under gas pressure (from the gas pump—not shown) moves the center portion of the valve from a closed position 56 to an open position 58. The "duck" valve for gas exhaust could be somewhat larger valve compared to the "input" "duck" valves.

It should be noted that a "duck" valve 54 could also be applied to one or more embodiments of the invention as a safety device. In this manner, the "duck" exhaust value 54 could be used a safety or relief valve 43 to prevent unwanted amount of buildup gas pressure in the hollow interior. The "duck" valve 54 could be capable of specifically releasing a gas from the hollow interior 51 when the gas pressure in the hollow interior 51 reaches a predetermined pressure such as 10 PSI.

FIGS. 8, 8A, 9, 9A, and 11A substantially shows an embodiment of the invention using another valve type (e.g., intake, relief and exhaust valves) a disk-type valve 60. The disk valve 60 could use flaps or discs 62 that open and close to regulate gas flow. The disk valve 60 further comprise an activation arm 64 movably mounted on the skin contacting plate. In this embodiment, disc valve 60 on the underside of the skin contacting plate 30 could allow the gas pump to freely pass gas into the hollow interior 52 while the flap or disc valve 60 on the topside could be used as an exhaust valve 46 for the hollow interior gas 58. The operation of the topside exhaust disc valve 60 could be regulated by an end of an activation arm 34 that is normally biased to hold down the topside exhaust disc valve 46 is a closed position. The other end of the activation arm 30 could act as a lever (over the skin contacting plate 30) to pivot or lift up the end located over the exhaust disc valve 46 o allow the disc valve to open and allowing the hollow interior gas 58 to exhaust from the hollow interior 51. The fulcrum portion could be provided by the structure of air pump 20 (e.g., compressible chamber) in a form of a boot 66 that receives the end of the activation arm 34 to engage the exhaust valve hook 68 of the exhaust disk valve 60 to lift up the valve into the open position when the activation arm is press down towards the skin contacting plate 30.

This boot configuration allows the flexing motion of the lever 34 to actuate opening of the exhaust disk valve 64 to release the pressure within the bladder 50 while maintaining the hermetic integrity of the gas pump 20 during pumping usage.

For the "flap" type valve configuration, exhaust valve 42 could have a smaller operating diameter as compared to intake (air pump) valve 41. This could be done to effectively reduce the gas pressure force (from the hollow interior 52) against the exhaust valve 54 due to the smaller surface area.

Figure 10:
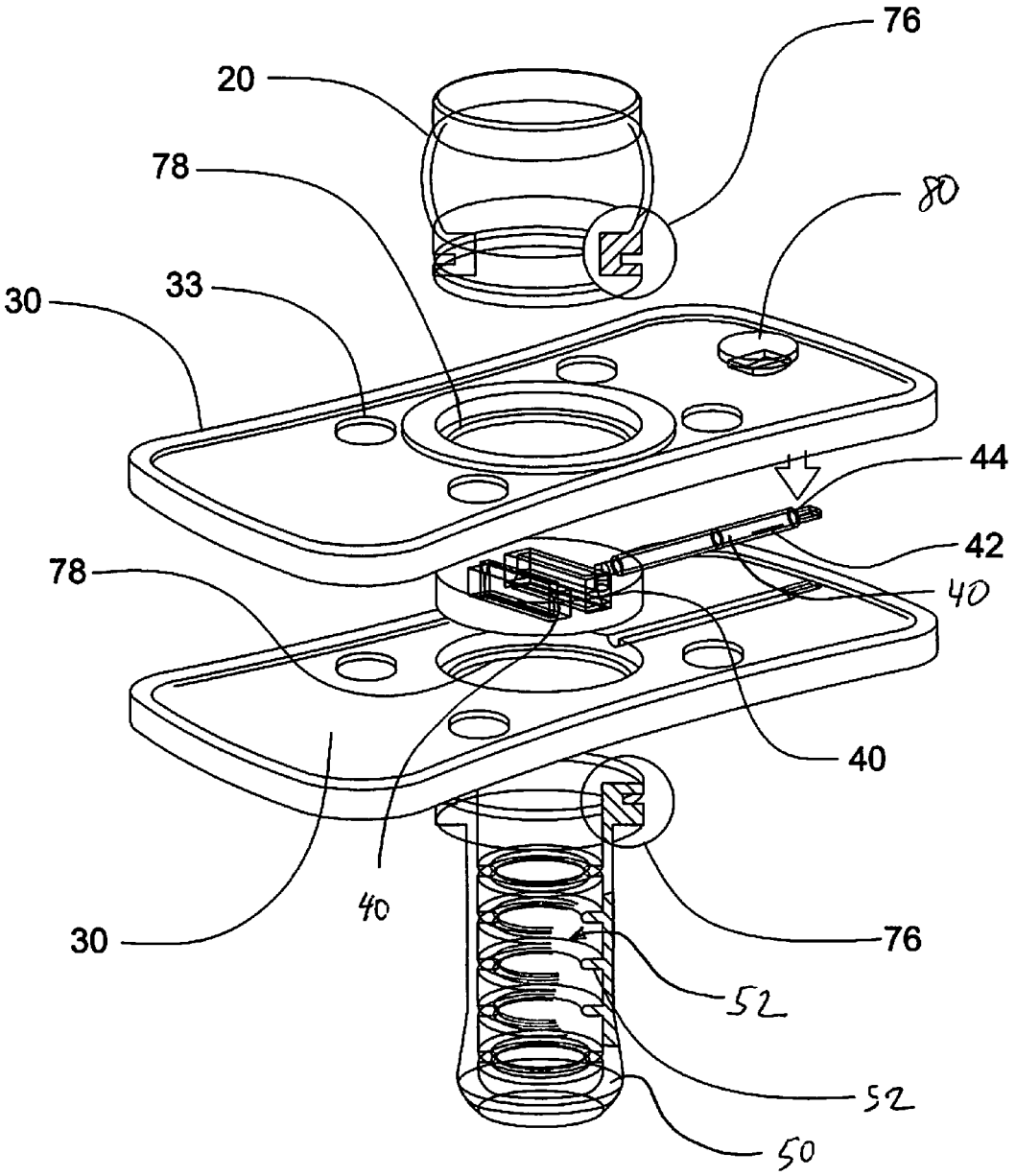
FIG. 10 is showing an exploded drawing of one possible way of assembling the invention.
Figure 11:
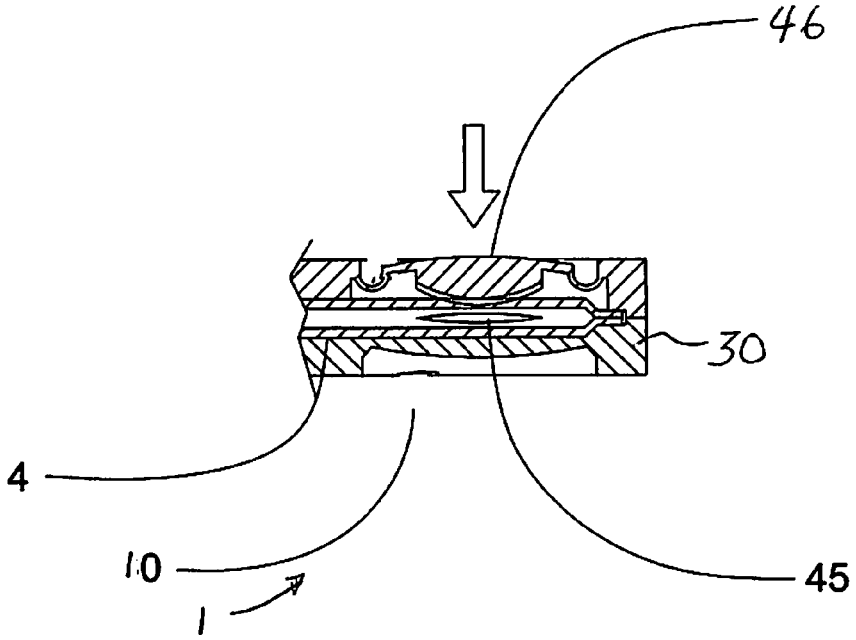
FIG. 11 is substantially showing a side elevation cutaway of the deformation of slit valve by the movable button.
Figure 11A:
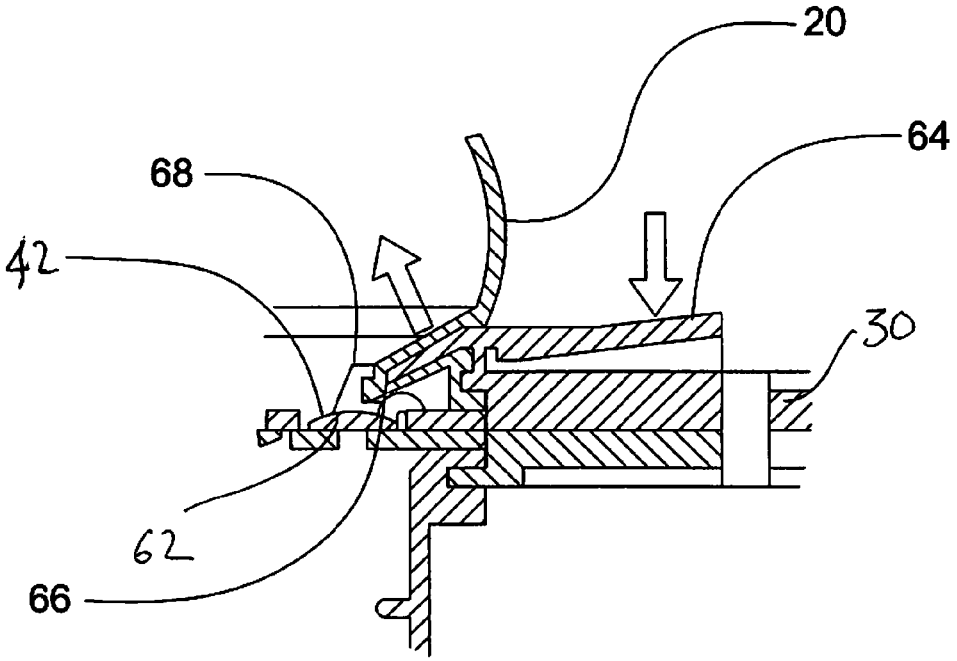
FIG. 11A is substantially showing a side elevation cutaway of activation arm engaging a valve.

As substantially shown in FIG. 10, shows one possible means of assembling the invention 1. The gas pump 20 could have a grooved radial slot 76 in the compressible chamber 20 that fits an outwardly projecting ring 78 provided by the one half of the skin contacting plate 30 designed to maintain air tight sealing without the use of sealants that may containment the device. Similarly the other half of the skin contacting plate 30 could feature another raised rim 78 to engage a groove 76 of the adjustable pneumatic nipple 50 to forge an air tight connection between the two. A support disk 40 containing one or more valves 40 could be held between the two raised rims 78 to be sandwiched in an air tight manner between the air pump and the pneumatic nipple. The adjustable pneumatic nipple 50 in one embodiment could further feature defines the interior ribs 54 that are the anti-expansion structures that hold the maximum outside diameter of the pneumatic nipple 50 constant.

Figure 12:
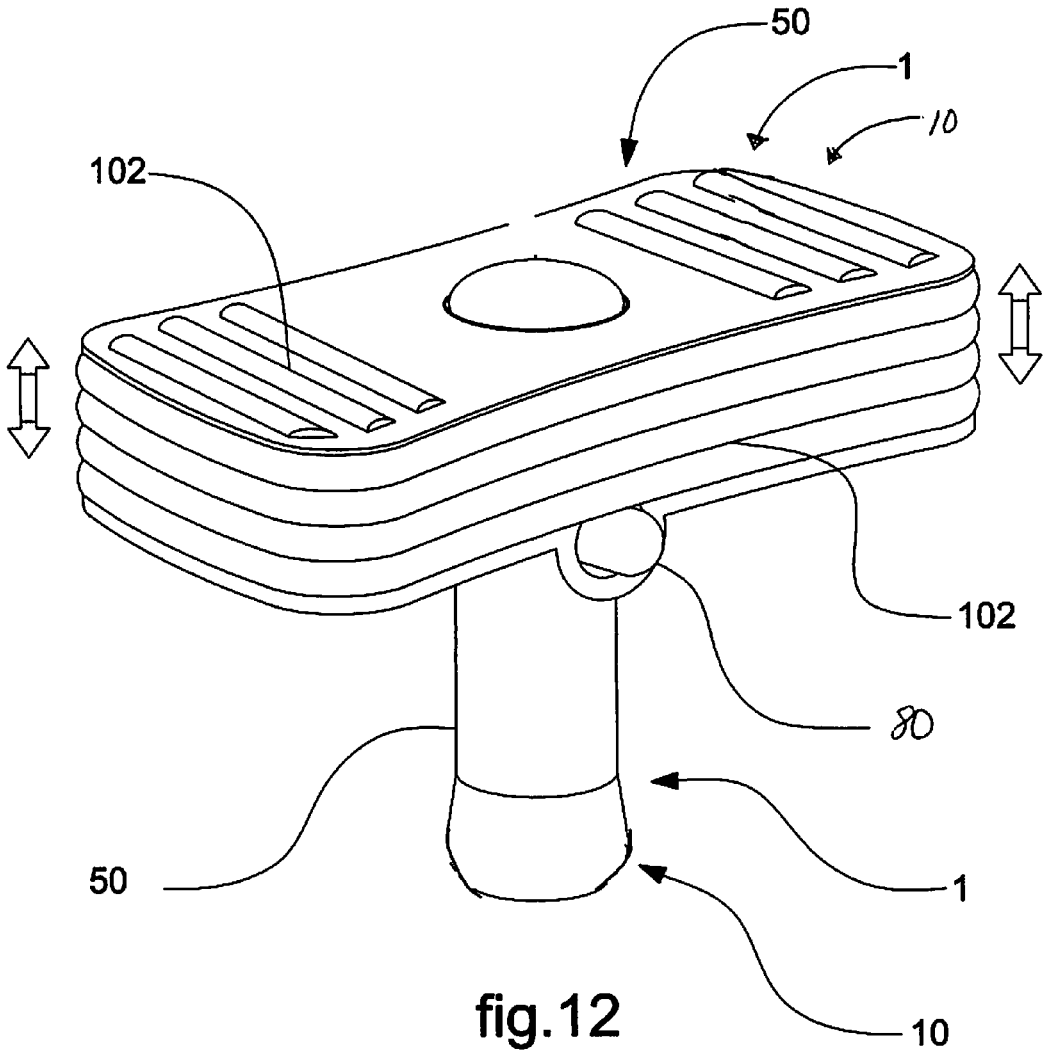
FIG. 12 is substantially showing a perspective view of a closed system embodiment of the invention with an inflated pneumatic nipple.
Figure 13:
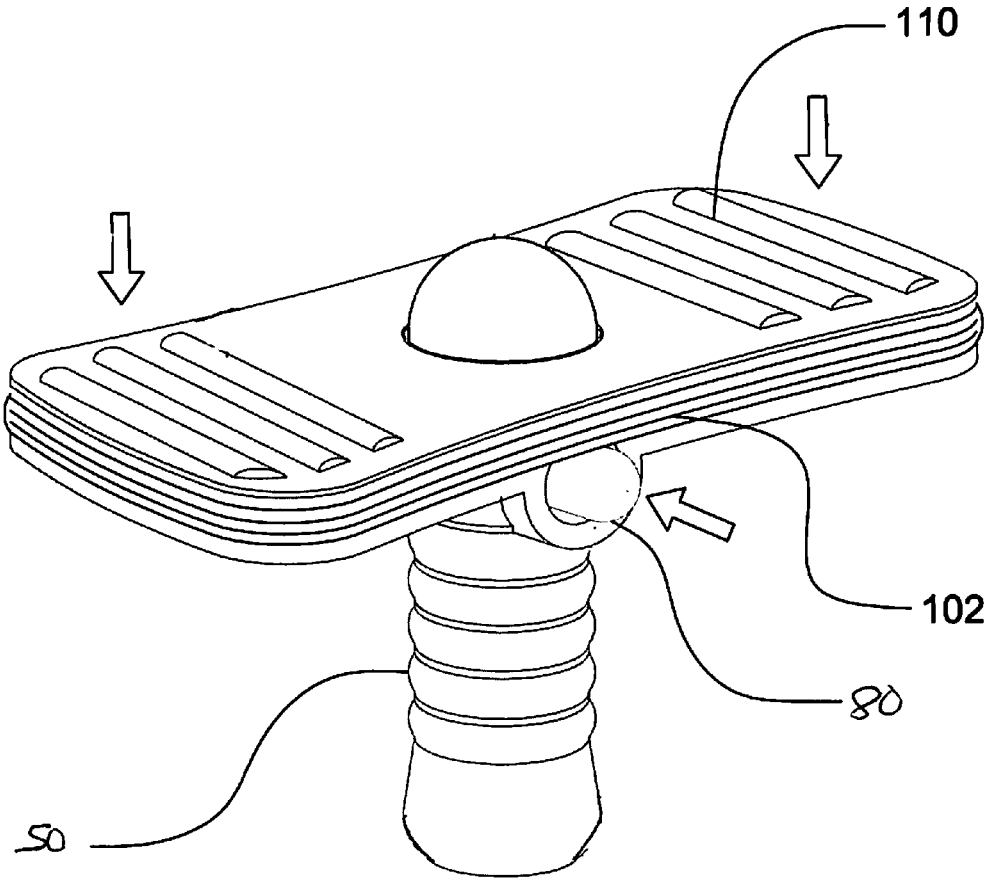
FIG. 13 is substantially showing a perspective view of a closed system embodiment of the invention with an inflated gas pump.

As substantially shown in FIGS. 12 and 13 could be a closed gas system in which the gas pump 20 connected by a valve(s) (shown in other figures) to the adjustable pneumatic nipple 50 forms a closed gas system having captive gas that does not come in from or leave to an environment external to the invention 1. The gas leaving the gas pump 20 moves into the pneumatic nipple 50 while the gas from the pneumatic nipple moves back into the gas pump 20. The gas pump 20 could a flexible bellows 102 type enclosure. In use, the gas could be is selectively moved from the flexible bellows 102 to the pneumatic nipple 50 by compressing the flexible bellows 102 together. Once squeezed fully, the gas is transferred to the pneumatic nipple 50 making it a) harder (e.g., higher durometer) and b) optionally textured with outwardly facing rings or bumps formed by interior ribs 54 (as substantially shown in FIG. 10.) These features are meant offer an effective surface to the infant during teething episodes. The expansion of specific areas of the pneumatic nipple could also be controlled by bladder wall thickness.

To release the pressurized nipple when desired, a button 80 could deform and open the exhaust valve (e.g., "duck" valve—not shown) causing gas to flow from the pneumatic nipple 50 and go back into the bellows 102. The bellows 102 could be designed with elastic memory so as to draw the gas back from the pneumatic nipple 104.

Figure 14:
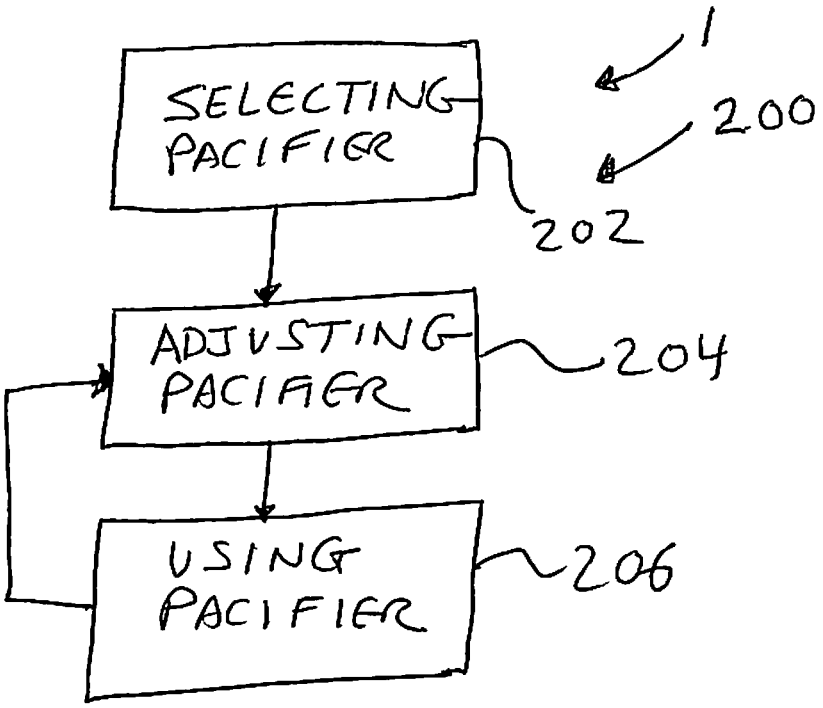
FIG. 14 is substantially showing a flow chart schematic for one embodiment for a method or process of operating the invention

As substantially shown in FIG. 14, one possible method or process 200 for operating the inflatable baby pacifier 5 could start with step 202, selecting the pacifier. The pacifier could come in several sizes dependent upon the age and size of the infant and the infant's suckling needs (teething/non-teething). Also the inflatable baby pacifier could be further selected on adjustable pneumatic nipple characteristics (ribbed, non-ribbed, etc.)

After appraising the infant's physical characteristics, suckling/teething needs, a suitable (e.g., appropriately sized adjustable pneumatic nipple having other desirable desired characteristics) inflatable baby pacifier could be selected for the infant. After this step was substantially completed, the process 200 could move onto step 204, adjusting the inflatable baby pacifier.

In step 204, adjusting the inflatable baby pacifier, the pacifier's adjustable pneumatic nipple could be left flaccid (if teething has not occurred yet and a soft and supple nipple is desired for the infant's usage) or if a firmer adjustable pneumatic nipple is desired or to expose additional adjustable pneumatic nipple characteristics (e.g., ribbing for teething purposes). In such an instance, the gas pump for the baby pacifier could be activated. In one version, the gas pump could a compressible envelope with a first opening to connect an envelope's interior to the exterior environment and another opening connecting to a valve leading to the hollow interior of the adjustable pneumatic nipple. In such a version of the invention, the valve could pose greater resistance to gas moving out of the hollow interior than gas being moved by the pump into the hollow interior.

An operator (e.g., parent of the infant) could place their thumb to cover the first opening and compress the envelope to force the gas (e.g., air) in the envelope interior through the valve and into the hollow interior of the adjustable pneumatic nipple to further inflate the nipple to desired hardness/firmness or to expose/present other features of the adjustable pneumatic nipple (e.g., ribbing etc.)

If the operator has overinflated the adjustable pneumatic nipple (e.g., via the gas pump) past the point of desired firmness, the operator could take steps to deflate the adjustable pneumatic nipple. In one version, the first valve when subject to even greater pressure in the hollow interior could allow passage of the gas in the hollow interior back into the envelope (e.g., the operator could manually squeezing the interior of the adjustable pneumatic nipple to deflate the adjustable pneumatic nipple.) Other ways of deflating the adjustable pneumatic nipple to desired level could be the use of a second valve dedicated to the deflation purpose (the first valve being dedicated to the inflation purpose.) A second valve could allow movement of gas out of the adjustable pneumatic nipple when the nipple is manually deformed by a button or like that is pressed by the operator. Such a valve could transmit the gas back into the gas pump envelope or vent the gas directly to the environment outside of the inflatable baby pacifier.

In one possible version, the first and second valve are part of a closed system wherein gas is sealed in the closed system, moving only between the gas pump and the adjustable pneumatic nipple's hollow interior and not moving in to or out of the external environment. In yet another version of the invention, a third valve could be used to augment the actions of the first and second valves in that the third valve could be a dedicated relief valve to the adjustable pneumatic nipple to prevent the operator from overinflating the adjustable pneumatic nipple.

Once the inflatable baby pacifier has reached its desired firmness, the process 200 could proceed to step 206, using the inflatable baby pacifier.

In step 206, using the inflatable baby pacifier, the adjustable pneumatic nipple is inserted into the child's mouth to allow the child to suckle/teeth upon the invention. As needed to adjust the firmness of the adjustable pneumatic nipple to provide for comfort of the child and alike, the process could return to step 204.

CONCLUSION

Although the description above contains many specifications, these should not be construed as limiting the scope of the invention but as merely providing illustrations of some of the presently preferred embodiments of this invention. Thus, the scope of the invention should be determined by the appended claims and their legal equivalents rather than by the examples.

As shown in the specification and drawings, the invention is an inflatable baby pacifier that has an adjustable pneumatic nipple that addresses changing teething and suckling needs for an infant as it grows. A gas pump along with one or more valves connecting to the hollow interior of the adjustable pneumatic nipple can be used to inflate (or deflate as the case may be) the adjustable pneumatic nipple to desired hardness or suppleness. The inflatable baby pacifier can be then be adjusted to the infant's suckling and/or teething needs.

What is claimed is:

1. A baby pacifier with a pneumatically inflated nipple comprising:

(A) a two-sided skin contacting plate that supports a gas pump, a first valve, a second valve and an adjustable pneumatic nipple;

(B) the gas pump being supported on one side of the two-sided skin plate;

(C) the adjustable pneumatic nipple forming a hollow interior, the adjustable pneumatic nipple being supported on an other side of the two-sided skin plate;

(D) the first valve connects the gas pump to the hollow interior;

wherein the gas pump is capable of sending a gas through the first valve into the hollow interior, the second valve is located on the skin contacting plate spaced laterally from and outside the gas pump and adjustable nipple, the second valve is used to vent gas away for the hollow interior.

2. The baby pacifier of claim 1 where the first valve is constructed to provide less resistance to a movement of the gas from the gas pump to the hollow interior than to a movement of the gas from the hollow interior to an environment external to the hollow interior.

3. The baby pacifier of claim 2 wherein the environment external to the hollow interior is the gas pump.

4. The baby pacifier of claim 2 wherein the environment external to the hollow interior is external to the baby pacifier.

5. The baby pacifier of claim 1 wherein the gas pump has an aperture that is sealed by being covered by a portion of the operator's hand when the gas pump is compressed to force gas through the first valve.

6. The baby pacifier of claim 1 wherein the first valve can be deformed to lessen the valve's resistance to the movement of gas from the hollow interior to an environment external to the hollow interior.

7. The pacifier of claim 1 wherein an amount of gas sent by the gas pump into the hollow interior changes the firmness of the adjustable pneumatic nipple.

8. The pacifier of claim 1 wherein the second valve is operator-controlled to exhaust the gas.

9. The pacifier of claim 1 wherein the second valve can be a valve from a group of valves comprising of a duck valve, a slit valve and a disc valve.

10. The pacifier of claim 1 wherein the adjustable pneumatic nipple houses interior ribs that are capable of limiting the expansion of the pneumatic nipple caused by the introduction of gas into the hollow interior.

11. A baby pacifier with a pneumatically inflated nipple comprising:

(A) a two-sided skin contact plate that supports a gas pump and an adjustable pneumatic nipple, the gas pump being supported on one side of the two-sided skin plate while the pneumatic nipple forming a hollow interior is supported on an other side of the two-sided skin plate;

(B) a first valve continuously connecting the gas pump to the hollow interior;

(C) a second valve for venting a gas in the hollow interior to an environment external to the hollow interior, the second valve being located on the skin contact plate spaced laterally from and outside the gas pump and the pneumatic nipple;

wherein the gas pump is capable of moving the gas into the hollow interior through the first valve to increase the firmness of the pneumatic interior.

12. The baby pacifier of claim 11 wherein a first resistance of the first valve to the movement of gas into the hollow interior is less than a second resistance of the first valve to the movement of gas from the hollow interior.

13. The baby pacifier of claim 11 wherein the second valve's resistance to the venting of gas from the hollow interior to an environment external to the hollow interior is operator-controlled.

14. The baby pacifier of claim 11 wherein the second valve is deformed when the operator acts upon the second valve.

15. The baby pacifier of claim 11 wherein an environment external to the hollow interior is the gas pump, both the gas pump and the hollow interior being sealed off from an outside environment of the baby pacifier.

16. A method of operating a baby pacifier having an adjustable pneumatic pacifier, comprising the following steps, but not necessarily in the order shown:

(A) providing baby pacifier having a two sided skin contact plate, a one side supporting an inflatable nipple forming a hollow interior while another side supports a gas pump for inflating the inflatable nipple, a first valve for controlling the passage of air between the gas pump and the inflatable nipple, a second valve for releasing gas from the inflatable nipple, the second valve being located on the skin contact plate spaced laterally from and outside of the gas pump and the inflatable nipple;

(B) activating the gas pump to move air through the first valve;

(C) moving air into the hollow interior; and (D) changing the firmness of the inflatable nipple.

17. The method of claim 16 further comprising a step of venting the gas from the inflatable nipple through the second valve, the second valve being different from the first valve.

18. The method of claim 16 further comprises a step of venting the gas from the inflatable nipple through the first valve.

* * * * *